US005547278A

United States Patent [19]

Xie

[11] Patent Number: 5,547,278

[45] Date of Patent: Aug. 20, 1996

[54] MIXING MACHINE BOWL SUPPORT LOCK

[75] Inventor: Mark M. Xie, Tipp City, Ohio

[73] Assignee: Premark FEG Corporation, Wilmington, Del.

[21] Appl. No.: 412,965

[22] Filed: Mar. 29, 1995

[51] Int. Cl.[6] ..... B01F 15/00

[52] U.S. Cl. ..... 366/203; 366/206; 366/207; 74/411.5

[58] Field of Search ..... 366/64, 65, 96–99, 366/197, 203, 206, 207, 208, 212, 240; 74/411.5; 70/190, 191, 207, 209, 210, 211, 224, DIG. 9

[56] References Cited

U.S. PATENT DOCUMENTS

| | | | |
|---|---|---|---|
| 1,085,730 | 2/1914 | Hackstedde | 366/207 |
| 1,151,295 | 8/1915 | Schlueter | 366/197 X |
| 1,158,198 | 10/1915 | Franke | 366/197 X |
| 1,366,114 | 1/1921 | Boggs | 70/190 |
| 1,548,919 | 8/1925 | Ward | 366/98 |
| 1,695,345 | 12/1928 | Read | 366/207 |
| 1,733,945 | 10/1929 | Dehuff | 366/207 |
| 1,747,443 | 2/1930 | Johnston | 366/207 |
| 1,761,237 | 6/1930 | Schiff | 366/197 X |
| 1,846,405 | 2/1932 | Stroud . | |
| 2,181,079 | 11/1939 | Dehuff | 366/207 |
| 2,251,903 | 8/1941 | Anstice et al. . | |
| 2,300,542 | 9/1942 | Forse . | |
| 2,710,743 | 6/1955 | Betry . | |
| 3,633,719 | 1/1972 | Lynch | 70/190 X |
| 4,548,054 | 3/1984 | Levine | 62/342 |
| 4,647,214 | 3/1987 | Kibby | 366/211 |
| 4,823,633 | 4/1989 | Pike | 74/411.5 |
| 5,116,134 | 5/1992 | Edwards et al. | 366/208 |
| 5,157,983 | 10/1992 | Sankovic | 74/411.5 |
| 5,251,978 | 10/1993 | Hall et al. | 366/198 |
| 5,348,393 | 9/1994 | Pappas, Jr. | 366/207 |
| 5,353,697 | 10/1994 | Venturati et al. | 99/492 |

FOREIGN PATENT DOCUMENTS

| | | |
|---|---|---|
| 4012017 | 6/1991 | Germany . |
| 1022796 | 9/1967 | United Kingdom . |

*Primary Examiner*—Charles E. Cooley
*Attorney, Agent, or Firm*—Thompson Hine & Flory P.L.L.

[57] ABSTRACT

The invention is a lock for the bowl support of a food mixing machine. After the bowl is raised into the mixing position, the lock ensures that the bowl maintains its position and is not subject to creep. The mixing machine comprises a mixing head, a mixing bowl support for supporting a mixing bowl under the mixing head, a gear train for moving the bowl support and mixing bowl into position beneath the mixing head, and a lock which engages the gear train to prevent the bowl support from moving out of position beneath the mixing head during mixing. The lock is preferably a pawl which engages one of the gears in the gear train, preventing the bowl and the bowl support from moving out of position.

10 Claims, 6 Drawing Sheets

MIXING MACHINE BOWL SUPPORT LOCK

STATEMENT OF THE INVENTION

This invention relates to a mechanism for preventing the bowl support of a mixing machine from moving out of position due to mixing force and vibrations caused by the operation of the mixing machine.

BACKGROUND OF THE INVENTION

One problem that has historically plagued large volume mixing machines is known as "bowl creep". In these large volume mixing machines, a rotatable crank handle moves a mechanical screw, which raises and lowers a bowl support. Under the force of the beaters and the vibration of the mixer, there is a tendency for the screw, which raises and lowers the bowl support, to "unscrew" thereby allowing the support to lower and the bowl to move away from the beaters and the mixing position. The movement of the bowl away from the beaters often results in incomplete mixing of the ingredients in the mixing bowl.

To prevent the bowl support and, subsequently, the bowl from moving during the mixing operation, an operator will usually tie down the crank handle which is used to raise and lower the mixing bowl. Ropes, bungy cords, and the like have been used for this purpose. This method has not been entirely successful because it requires space to tie down the mixer handle which in turn hinders the operator's effective use of the mixing machine. Further, the mixer must be "untied" before new ingredients can be added to the mixing bowl or before the mixing bowl can be moved away from the mixing head.

Another method to prevent bowl "creep" is to reduce the lead angle and/or increase the thread angle of the screw in the gear train used to raise and lower the bowl support, so that a slight movement of the gear train causes a minute movement of the bowl support, i.e., little to no bowl "creep." However, a mixer incorporating this approach requires the operator to expend a great effort to raise the mixing bowl into position for a mixing operation. This approach is not desirable because it requires a large number of cranks on the handle used to raise and lower the bowl support to cause the bowl support to move a short distance toward the mixing head. Finally, as the mixing machine ages, as parts wear and as fasteners become loosened, bowl "creep" may still occur.

The current invention offers an improved mechanism to maintain the bowl support and, subsequently, the mixing bowl of a mixing machine in the proper operating position during a mixing operation.

SUMMARY OF THE INVENTION

The mixing machine includes a housing and a mixing head mounted to and extending from an upper portion of the housing. The mixing machine also includes a removable mixing bowl for holding ingredients to be mixed and a bowl support for supporting the mixing bowl under the mixing head. The bowl support is raised and lowered by means of a gear train. To maintain the mixing bowl in proper position beneath the mixing head during a mixing operation and to prevent the bowl support and, subsequently, the bowl from moving out of position beneath the mixing head during the mixing operation, the mixing machine includes a lock which engages a gear in the bowl support gear train to prevent movement of the bowl support.

The lock preferably utilizes a pawl, which engages a gear in the gear train to prevent the gear train from moving due to mixing force and vibration of the mixing machine, and a means for moving the pawl into contact with the gear. Typically, the means for moving the pawl into contact with the drive gear is a solenoid.

In one embodiment of the invention, the gear train includes a screw which, at one end, is received in a threaded aperture in the bowl support such that rotation of the screw causes the bowl support to move toward or away from the mixing head. At its second end the screw is coupled to a gear train in which a gear is engaged by the lock to prevent the bowl support from moving during a mixing operation.

The mixing machine may also include a sensor for detecting the position of the bowl support beneath the mixing head. The sensor forms part of an electric circuit that prevents the motor and the bowl support lock unit from activating if the bowl support is not properly positioned beneath the mixing head. This sensor can be overridden by means of a start switch which bypasses the circuit and which requires the operator to constantly depress the switch to keep the motor operating the mixing head.

DETAILED DESCRIPTION OF THE INVENTION

Figure 1:
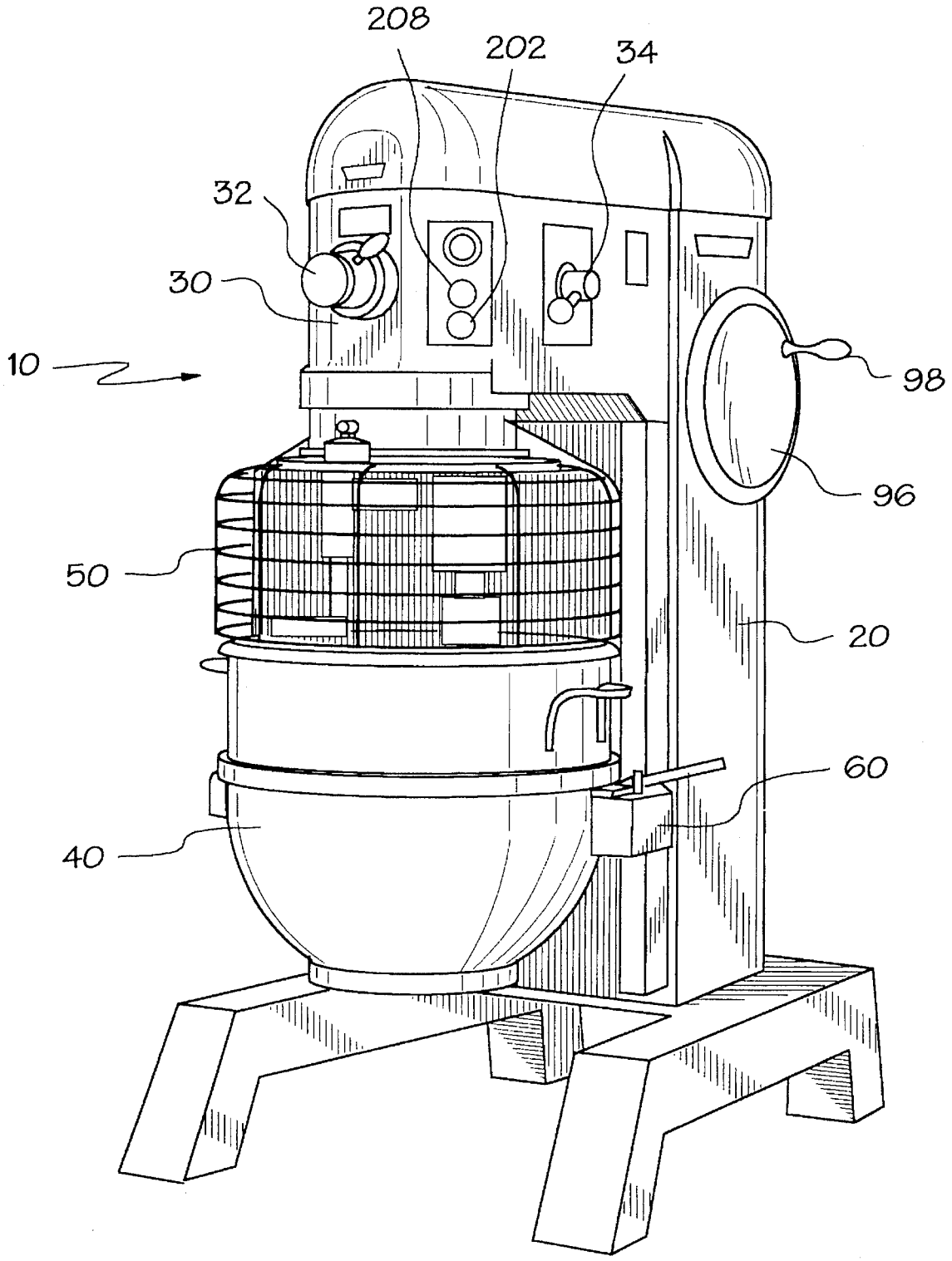
FIG. 1 presents a perspective view of a mixing machine.

FIG. 1 presents a perspective of a mixing machine 10. Mixing machine 10 includes a housing 20, a mixing head 30, a mixing bowl 40, a bowl guard 50, a bowl support 60, a wheel 96 and a handle 98. Mixing head 30 extends from an upper portion of housing 20 and contains a drive train which drives a conventional, detachable mixer/beater attachment (not shown). Mixing head 30 also includes an optional attachment drive port 32 which can be used as an auxiliary attachment drive means and a speed adjustment means 34 which is used to adjust the speed of the mixer/beater attachment. Stop switch 202 and start switch 204 are also mounted on mixing head 30. Bowl guard 50 engages mixing head 30 to inhibit access to mixing bowl 40 and the mixer/beater attachment during a mixing operation. Mixing bowl 40 is supported beneath mixing head 30 by bowl support 60. Bowl support 60 is raised and lowered to move bowl 40 into position beneath mixing head 30 by handle 98 which is rotatably mounted on wheel 96.

Figure 2:
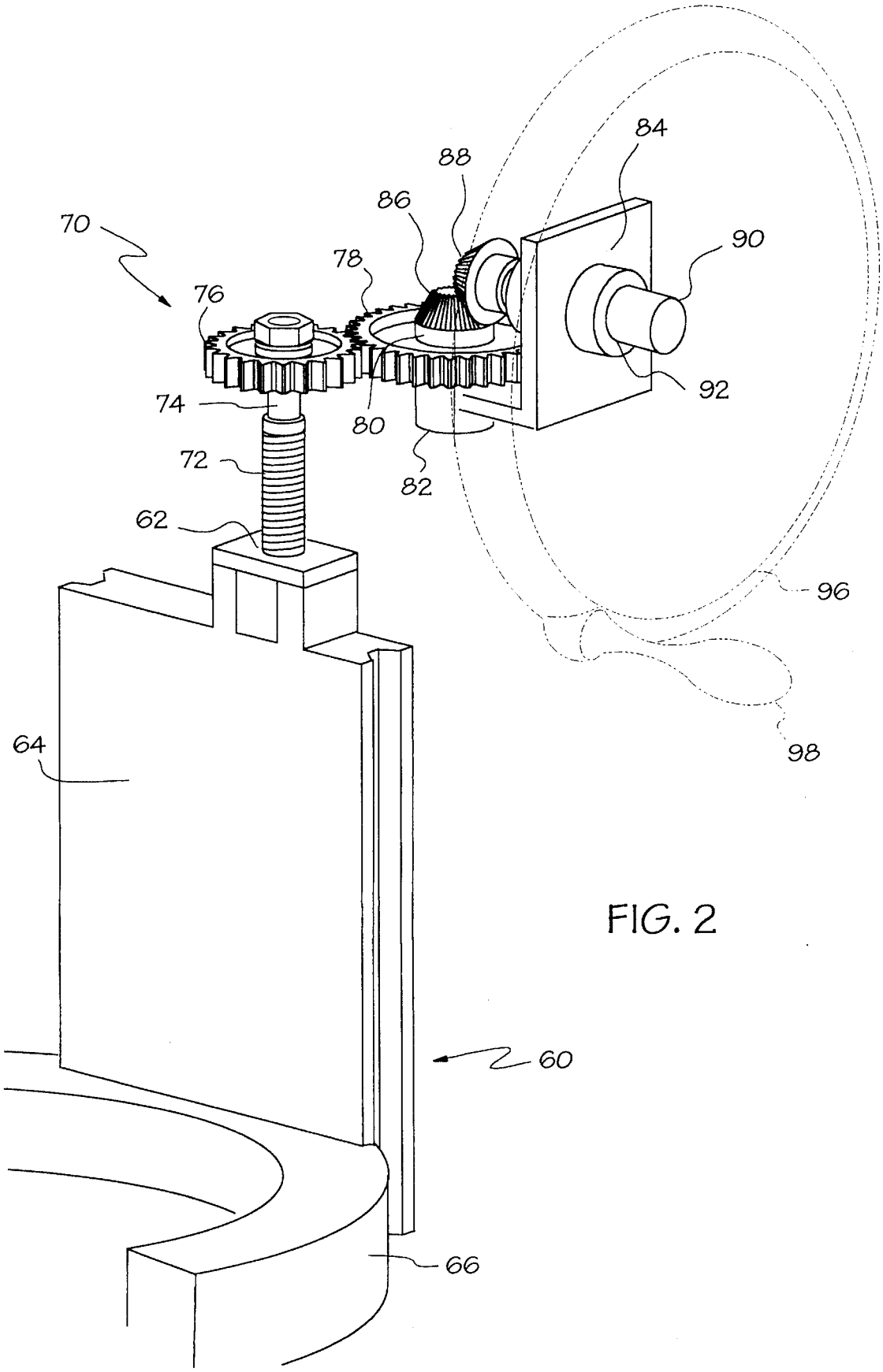
FIG. 2 presents a perspective view of the gear train which raises and lowers the bowl support.

FIG. 2 presents a perspective view of a gear train 70 which raises and lowers bowl support 60. Bowl support 60 comprises a body 64 and a yoke 66. Yoke 66 extends from body 64 and supports mixing bowl 40 on bowl support 60.

At its end opposite yoke 66, body 64 has a threaded aperture 62. Gear train 70 includes a long screw 72, which, at a first end, engages threaded aperture 62 in body 64. Shaft 74 extends from the second end of screw 72. Screw gear 76 is mounted on shaft 74. Screw gear 76 engages drive gear 78 which is mounted on shaft 80. Shaft 80 is rotatably mounted in aperture 82 in bracket 84. Bevel drive gear 86 is also mounted on shaft 80 on one side of drive gear 78. Bevel drive gear 86 engages bevel crank gear 88 which is mounted on the end of shaft 90. Shaft 90 is rotatably mounted in aperture 92 in bracket 84. At its end opposite of bevel crank gear 88, shaft 90 engages wheel 96. Wheel 96 is rotated by handle 98 which is rotatably mounted on wheel 96.

Figure 3:
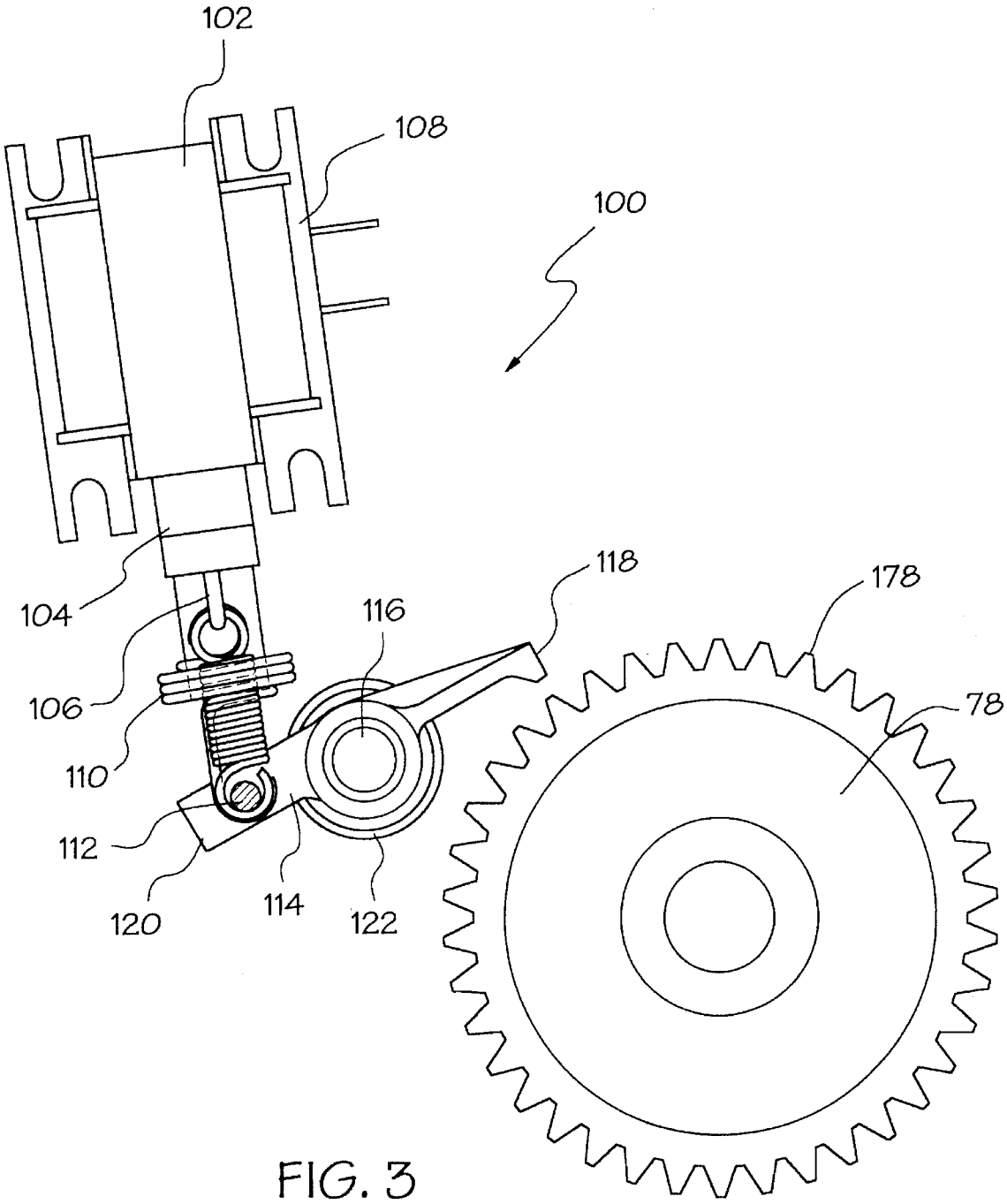
FIG. 3 presents a perspective view of the lock in an open position.

FIG. 3 presents a perspective view of the lock 100 which prevents bowl support 60 from moving away from mixing head 30 during a mixing operation. Lock 100 includes a solenoid 102, a solenoid arm 104, a mounting bracket 108 and a pawl 114. Solenoid arm 104 extends from solenoid 102 and has hook 106 extending therefrom. Solenoid 102 is mounted on mounting bracket 108 and is linked with pawl 114. Mounting bracket 108 can be mounted at any position in housing 10 which would allow solenoid 102 to be linked with pawl 114. At one end of solenoid arm 104, spring 110 is detachably mounted on hook 106.

Pawl 114 is rotatably mounted on pawl axis 116. Pawl 114 has a first end 118 and a second end 120. First end 118 of pawl 114 is moved to engage drive gear 78 to prevent drive gear 78 from rotating as is described in detail below. Pawl axis 116 can be mounted at any position in housing 10 as long as the first end 118 of pawl 114 would be able to engage a gear in gear train 70 and, preferably be able to engage drive gear 78. In an "unlocked" position, first end 118 is biased away from drive gear 78 by means of a torsion spring 122. Post 112 extends from second end 120 of pawl 114 and is detachably engaged by spring 110 to link pawl 114 with solenoid 102.

Figure 6:
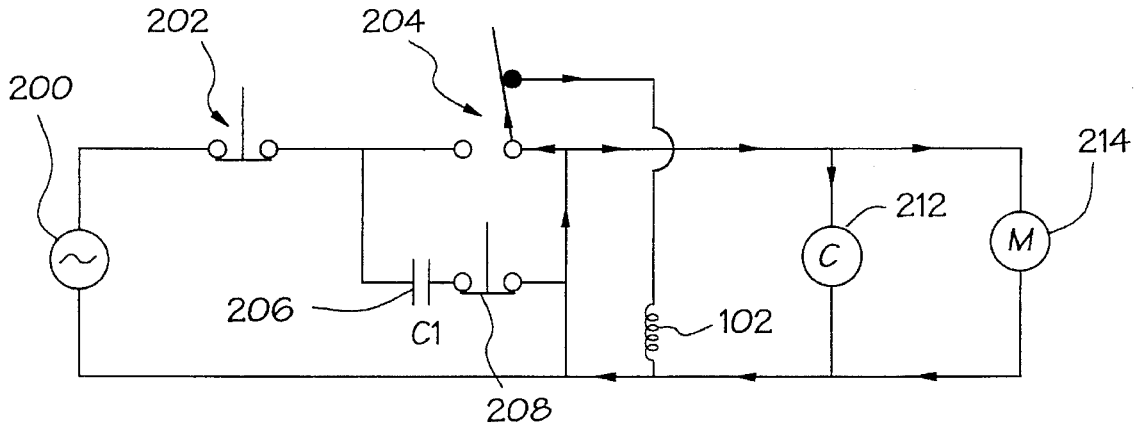
FIG. 6 presents a circuit diagram of the electrical circuit which operates the lock.
Figure 7:
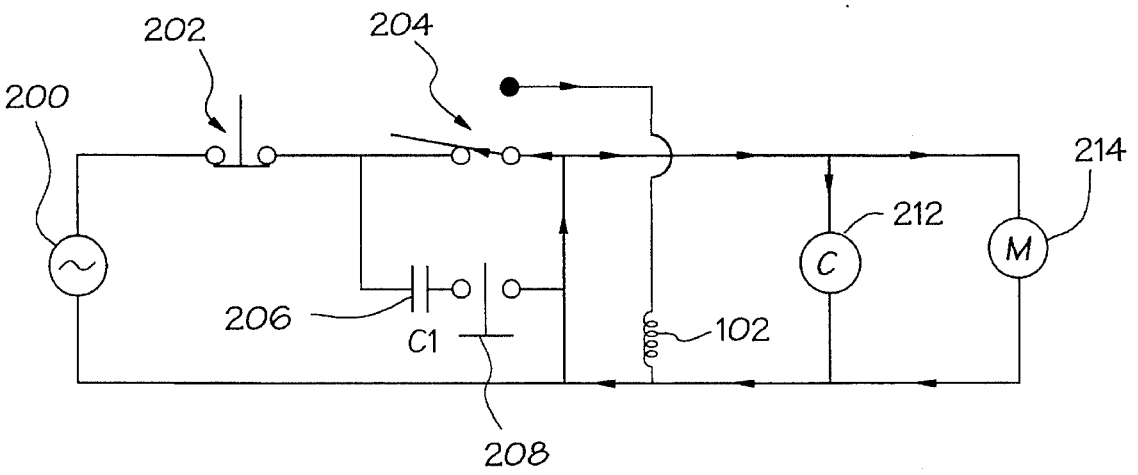
FIG. 7 presents a circuit diagram of the electrical circuit which operates the mixing machine without activating the lock.

FIGS. 6 and 7 present circuit diagrams illustrating the electrical controls for bowl support lock unit 100. The circuit diagrams show solenoid 102, a power source 200, a stop switch 202, a start switch 204, a relay contact 206, a bowl height sensor 208, a relay coil 212, and a motor 214. Power source 200 is a conventional AC power source. Electrical current is supplied to motor 214 when the series of connected switches are closed and is discontinued if one of the switches is open, as described below. Stop switch 202 is connected in series with start switch 204 and bowl height sensor 208. Start switch 204 and bowl height sensor 208 are connected in parallel. Solenoid 102 and motor 214 are each connected in series with bowl height sensor 208. Relay contact 206 is connected in series with bowl height sensor 208 and relay coil 212 is connected in parallel with motor 214. Motor 214 provides the power for the operation of mixing head 30. Once the current has completed the circuit, it flows through the remainder of the circuitry of the mixing machine 10.

Referring to FIG. 2, to move bowl support 60, handle 98 is rotated around wheel 96. As wheel 96 is rotated, shaft 90 is also rotated. Bevel crank gear 88 is rotated by means of shaft 90 and rotates bevel drive gear 86. Bevel drive gear 86 engages drive gear 78, causing drive gear 78 to rotate. As drive gear 78 rotates, it engages screw gear 76, which rotates shaft 74. As shaft 74 is rotated, screw 72 is turned in threaded aperture 62. Rotation of handle 98 in a first direction causes gear train 70 to move bowl support body 64 toward mixer head 30. Rotation of gear train 70 in a second direction, by means of handle 98, causes bowl support body 64 and bowl support 60 to be moved downwardly away from mixing head 30.

Although described herein as being manually operated by a crank, one skilled in the art will appreciate that gear train 70 may also be driven by a motor. This motor is conventional and within the skill of one practiced in the art. The motor could drive screw gear 76 either directly or through a drive train similar to that described above.

Figure 4:
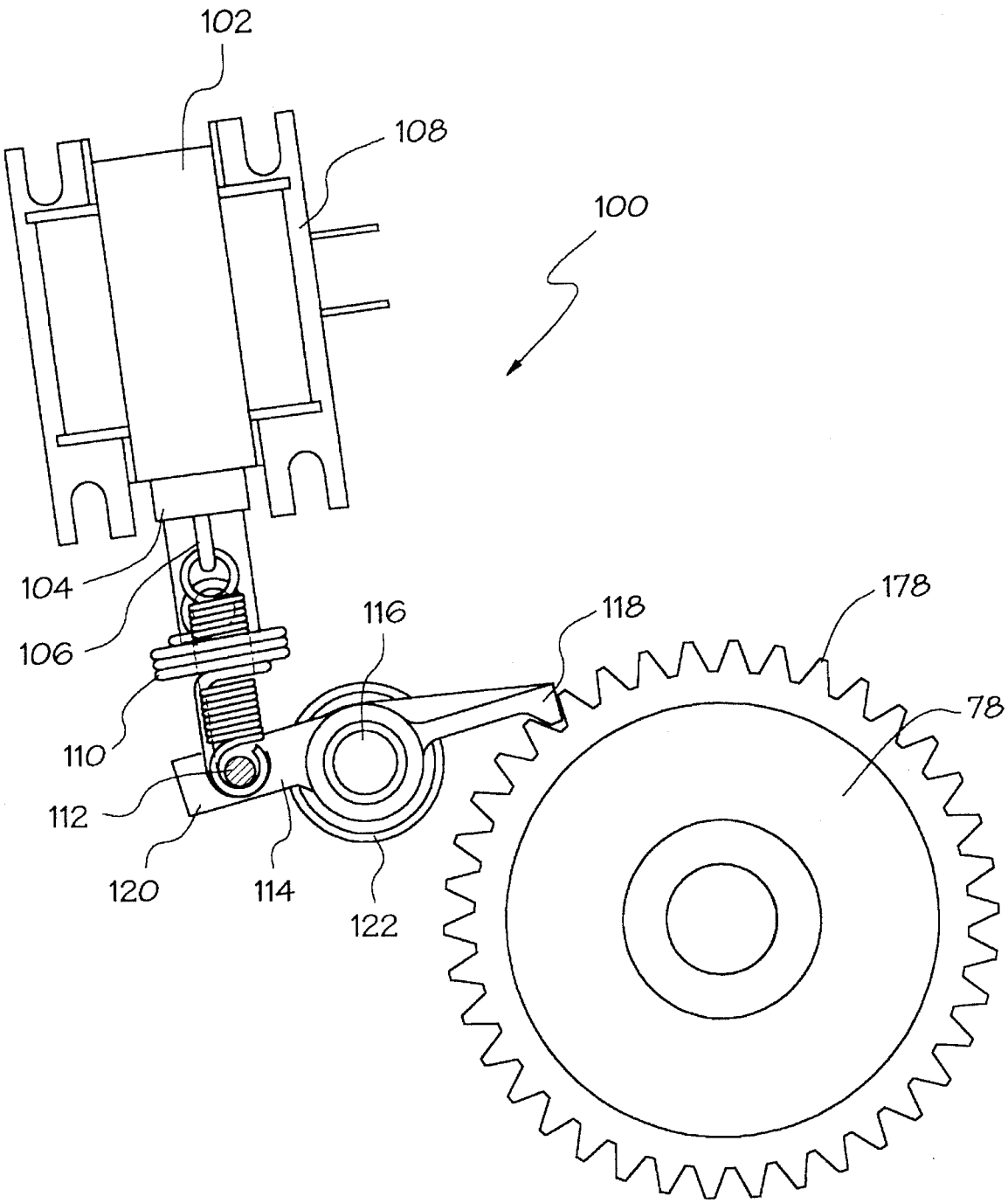
FIG. 4 presents a perspective view of the lock in a locked position.

As shown in FIG. 4, when lock unit 100 is activated, solenoid 102 draws solenoid arm 104 inwardly. As solenoid arm 104 moves inwardly, spring 110 is pulled toward solenoid 102 by hook 106. As spring 110 is drawn toward solenoid 102, spring 110 pulls second end 120 of pawl 114 toward solenoid 102. Spring 110 has sufficient force to overcome the biasing force of torsion spring 122, which biases first end 118 of pawl 114 away from contact with drive gear 78. First end 118 of pawl 114 then moves toward drive gear 78 as second end 120 is drawn toward solenoid 102 and the biasing force of torsion spring 122 is overcome. First end 118 then engages the teeth 178 of drive gear 78. When first end 118 engages teeth 178 of gear 78, pawl 114 occupies a "locked" position.

Once first end 118 of pawl 114 engages drive gear 78, gear train 70 is prevented from moving by either mixing force and vibrations due to the mixing operation or the movement of handle 98. Because drive gear 78 can not move, screw gear 76 and, subsequently, long screw 72 are also prevented from moving. If long screw 72 can not move, then bowl support 60 also can not move and mixing bowl 40 is maintained in position beneath mixing head 30.

The engagement of first end 118 of pawl 114 and drive gear 78 prevents adjustment of mixing bowl 40 during a mixing operation. The engagement prevents the movement of bevel drive gear 86 which engages bevel crank gear 88. With bevel crank gear 88 being prevented from moving, shaft 90 and, subsequently, handle 98 are also prevented from moving. Thus, handle 98 can not be rotated to move bowl support 60 either toward or away from mixing head 30.

Figure 5:
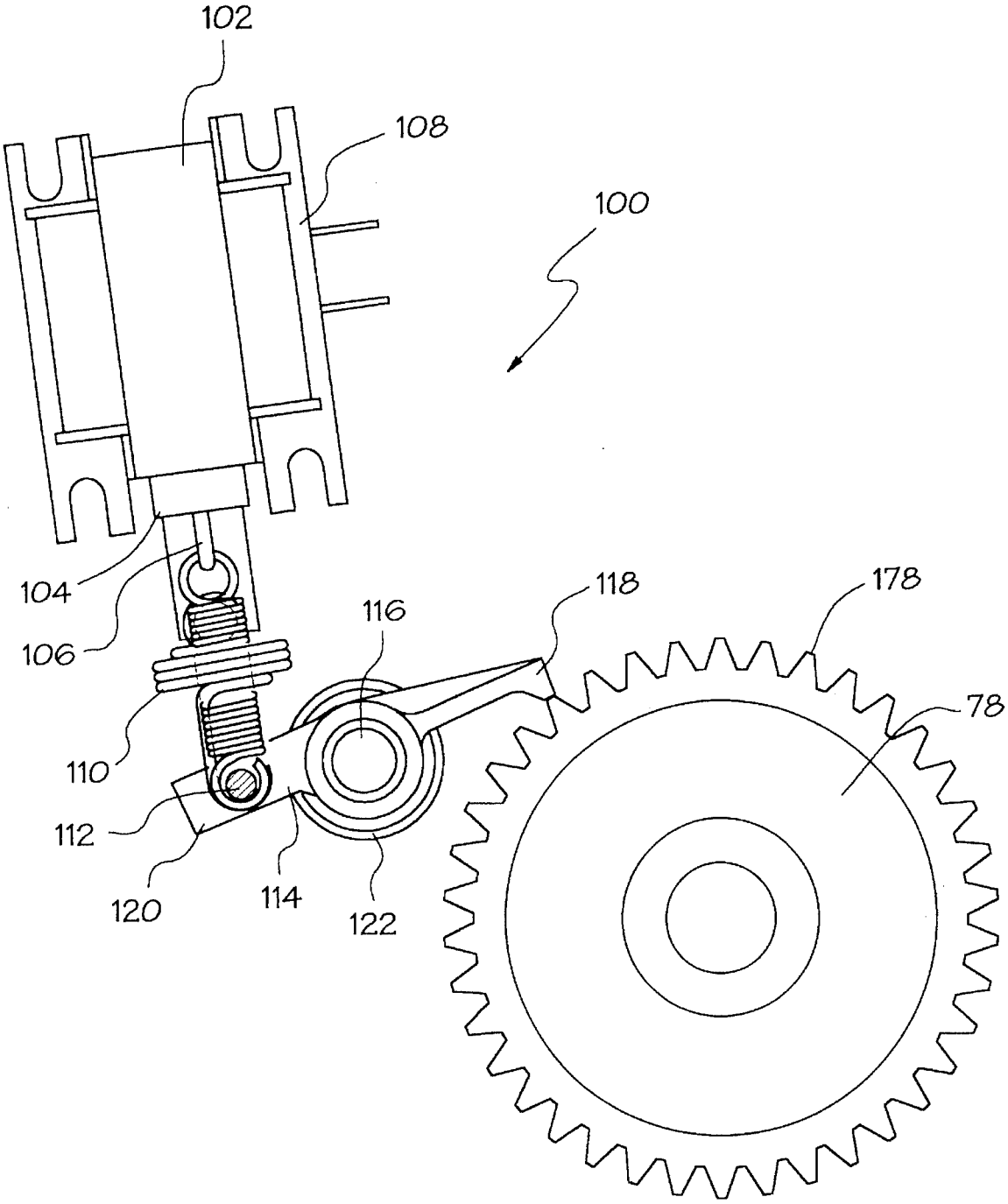
FIG. 5 presents a drawing showing the head of the pawl of the lock engaging the point of a gear tooth of one of the gears of the gear train shown in FIG. 2.

As illustrated in FIG. 5, spring 110 seats first end 118 of pawl 114 between gear teeth 178 on drive gear 78 without damaging solenoid 102 if pawl 114 engages the tip of a gear tooth 178. Spring 110 applies a force on first end 118 toward gear 78 by means of solenoid 102 drawing arm 104 back into itself. If first end 118 of pawl 114 becomes hung up on a gear tooth 178, spring 110 will stretch and allow solenoid arm 104 to completely draw back into solenoid 102. As gear 78 is vibrated during the mixing operation, the force applied by spring 110 causes first end 118 to seat in the nearest space between the gear teeth 178. Thus, spring 110 also prevents first end 118 from becoming hung up on the tip of a gear tooth 178 and not engaging gear 78.

Lock 100 can not be activated if mixing bowl 40 is not properly positioned beneath mixing head 30. To prevent bowl support 60 from being locked into a position other than one which is directly beneath mixing head 30, mixer 10 includes a bowl height sensor 208 which must be engaged to activate lock 100. Although it is not shown in the drawings, bowl height sensor 208 is located on housing 20 near the top of bowl support body 64. Bowl height sensor 208 is activated when bowl 40 is positioned by bowl support body 64 in position for a mixing operation. Typically, bowl 40 is properly positioned when bowl support body 64 is located at its maximum raised position, i.e., when handle 98 can no longer be rotated to raise bowl support 64. Once bowl 40 is properly positioned, bowl height sensor 208 completes the circuit to operate both solenoid 102 and motor 214 for mixing head 30, as shown in FIG. 6. When the circuit is completed, both solenoid 102 and motor 214 become energized. Once solenoid 102 is energized, pawl 114 is moved to engage drive gear 78, as described above, to prevent bowl support 60 from moving away from mixing head 30.

To lower bowl 40 and bowl support 64, the operator depresses stop switch 202. When stop switch 202 is depressed, the circuit to both solenoid 102 and motor 214 is broken. Once the circuit is broken, solenoid 102 de-energizes and pawl 114 returns to an "unlocked" position by operation of torsion spring 122. Torsion spring 122 causes pawl 114 to rotate around pawl axis 116. As pawl 114 rotates around axis 116, first end 118 withdraws from teeth 178 of gear 78 and second end 120 moves away from solenoid 102. Once first end 118 of pawl 114 disengages from drive gear 78, handle 98 may be rotated to allow bowl support 60 and, subsequently, bowl 40 to be lowered away from mixer head 30.

Often, the operator desires to operate mixer 10 at a position which would allow access to mixing bowl 40 without being obstructed by bowl guard 50. This usually occurs when the operator desires to add ingredients to a mixture while mixing head 30 is still operating. To allow mixing head 30 to operate without bowl height sensor 208 being engaged, mixer 10 includes start switch 204. In normal operation, start switch 204 remains in a first position to complete the circuit created when bowl height sensor 208 is engaged, as shown in FIG. 6. To operate mixer 10 without bowl height sensor 208 being engaged, start switch 204 is depressed bypassing both bowl height sensor 208 and solenoid 210 and moving start switch to a second position to complete the circuit to motor 214, as illustrated in FIG. 7. Once start switch 204 is depressed, the circuit to mixer motor 214 is completed and motor 214 is energized. To keep mixing head 30 operating, start switch 204 must be continually depressed. Once the operator discontinues depressing start switch 204, the circuit to motor 214 is broken and motor 214 is de-energized, mixing head 30 no longer operates, and start switch 204 returns to the position illustrated in FIG. 6. When the operator discontinues depressing start switch 204, start switch 204 returns to a position closing the circuit with solenoid 102. However, because bowl support 60 is not properly positioned beneath mixing head 30, bowl height sensor 208 is not engaged and motor 214 will not operate, as described above.

One skilled in the art will understand that, although pawl 114 has been described herein as engaging drive gear 78 to prevent bowl support 60 from vibrating out of position, pawl 114 can be designed to engage any gear in gear train 70 that would prevent gear train 70 from moving during a mixing operation. For example, pawl 114 could engage screw gear 76, bevel drive gear 86 or bevel crank gear 88 with equal effectiveness.

Having described the invention in detail and by reference to preferred embodiments thereof, it will be apparent that modifications and variations are possible without departing from the scope of the invention defined in the appended claims.

What is claimed is:

1. A mixing machine comprising:

a mixing head;

a mixing bowl support for supporting a mixing bowl under the mixing head;

a gear train comprising a plurality of intermeshing gears for raising and lowering the bowl support and mixing bowl into and out of position beneath the mixing head; and a lock which engages one of the gears of the gear train to prevent the bowl support from moving out of position beneath the mixing head during mixing;

wherein the gear train further includes a screw which, at a first end, is received in a threaded aperture in the bowl support such that by rotating the screw, the bowl support can be raised and lowered and, at a second end, has a screw gear mounted thereon, said screw gear being a part of the gear train which is engaged by the lock whereby the screw is prevented from rotating and the bowl support is prevented from moving out of position beneath the mixing head during mixing.

2. The mixing machine of claim 1 wherein the gear train includes a drive gear which engages the screw gear whereby the drive gear is engaged by the lock to prevent the screw from rotating and the bowl support from moving out of position beneath the mixing head during mixing.

3. The mixing machine of claim 2 wherein the lock comprises a pawl, which engages the drive gear, and means for moving the pawl into contact with the drive gear linked with the pawl.

4. The mixing machine of claim 1 wherein the lock comprises a pawl which engages the one gear of the gear train and means for moving the pawl into contact with the gear linked with the pawl.

5. A mixing machine comprising:

a mixing head;

a mixing bowl support for supporting a mixing bowl under the mixing head;

a gear train for moving the bowl support and mixing bowl into position beneath the mixing head, the gear train including a screw, a screw gear, and a drive gear;

the screw, at a first end, being received in a threaded aperture in the bowl support such that by rotating the screw, the bowl support can be raised and lowered, the screw gear mounted at a second end of the screw thereon, and the drive gear engaging the screw gear;

a pawl which engages the drive gear to prevent the screw from rotating and to prevent the bowl support from moving out of position beneath the mixing head during mixing; and means for moving the pawl into contact with the drive gear linked with the pawl;

wherein the means for moving the pawl into contact with the drive gear is a solenoid.

6. The mixing machine of claims 5 further comprising a sensor for detecting the position of the bowl support wherein the machine can not be operated if the sensor does not detect the bowl support in position beneath the mixing head.

7. The mixing machine of claim 6 wherein the sensor forms a part of an electronic circuit, wherein the sensor signals the pawl to activate when the bowl support is in position beneath the mixing head.

8. The mixing machine of claim 7 wherein the drive gear comprises a gear tooth and the pawl is linked to the solenoid by a spring which engages both the pawl and the solenoid so that the solenoid does not become damaged if the pawl engages a tip of the gear tooth.

9. The mixing machine of claim 8 further including a means for overriding the sensor.

10. The mixing machine of claim 9 wherein the gear train is driven manually by a crank.

* * * * *